US009845568B2

(12) United States Patent
Fung

(10) Patent No.: US 9,845,568 B2
(45) Date of Patent: Dec. 19, 2017

(54) PORTABLE HANDHELD STEAMER APPARATUS

(71) Applicant: CONAIR CORPORATION, Stamford, CT (US)

(72) Inventor: Kam Fai Fung, Tuen Mun (CN)

(73) Assignee: CONAIR CORPORATION, Stamford, CT (US)

( * ) Notice: Subject to any disclaimer, the term of this patent is extended or adjusted under 35 U.S.C. 154(b) by 0 days.

(21) Appl. No.: 15/028,830

(22) PCT Filed: Dec. 8, 2014

(86) PCT No.: PCT/CN2014/093302

§ 371 (c)(1),
(2) Date: Apr. 12, 2016

(87) PCT Pub. No.: WO2016/090538

PCT Pub. Date: Jun. 16, 2016

(65) Prior Publication Data

US 2017/0260685 A1 Sep. 14, 2017

(51) Int. Cl.

| | |
|---|---|
| ***D06F 87/00*** | (2006.01) |
| ***D06F 75/10*** | (2006.01) |
| ***D06F 75/18*** | (2006.01) |

(52) U.S. Cl.

CPC ..... *D06F 87/00* (2013.01); *D06F 75/10* (2013.01); *D06F 75/18* (2013.01)

(58) Field of Classification Search

CPC ..... D06F 75/10; D06F 75/18; D06F 75/19; D06F 75/24; D06F 87/00; F22B 1/28;
(Continued)

(56) References Cited

U.S. PATENT DOCUMENTS 2,655,746 A * 10/1953 McFarland ..... D06F 75/18 38/77.83
3,002,302 A * 10/1961 Flowers ..... D06F 75/18 38/77.5

(Continued)

FOREIGN PATENT DOCUMENTS

CN 101929671 A 12/2010
CN 202989633 U 6/2013

OTHER PUBLICATIONS

International Preliminary Report issued in corresponding Application No. PCT/CN2014/093302, 4 pages.

*Primary Examiner* — Ismael Izaguirre
(74) *Attorney, Agent, or Firm* — Lawrence Cruz, Esq.; Joseph W. Schmidt, Esq.

(57) ABSTRACT

A steamer apparatus, includes a housing defining a steam outlet, a fluid reservoir for storing fluid, a steam generator mounted in the housing and in fluid communication with the fluid reservoir for generating steam and releasing the steam through the steam outlet, a pump for pumping the fluid from the fluid reservoir to the steam generator, a trigger mounted to the housing and a trigger lock associated with the trigger. The trigger is adapted to move from an inoperative condition to an operative condition to activate one of the pump and the steam generator. The trigger lock is movable between a release position permitting free movement of the trigger between the inoperative condition and the operative condition and a lock position securing the trigger in the operative condition.

12 Claims, 11 Drawing Sheets

(58) Field of Classification Search
CPC . F17C 7/04; B65D 83/14; F41A 17/06; F41A 17/14; F41A 17/46; F41A 17/54
USPC ..... D32/17
See application file for complete search history.

(56) References Cited

U.S. PATENT DOCUMENTS

| | | | | |
|---|---|---|---|---|
| 4,496,826 | A * | 1/1985 | Osrow | D06F 75/14 219/245 |
| 4,571,483 | A * | 2/1986 | Fathi | D06F 87/00 38/69 |
| 5,341,541 | A | 8/1994 | Sham | |
| 6,031,969 | A | 2/2000 | Burr et al. | |
| 6,061,935 | A | 5/2000 | Lee | |
| D436,424 | S | 1/2001 | Buzzi | |
| 6,622,404 | B2 | 9/2003 | Valiyambath | |
| 6,839,933 | B2 | 1/2005 | Wheeler et al. | |
| 6,986,217 | B2 * | 1/2006 | Leung | D06F 73/00 38/77.83 |
| 7,155,117 | B2 | 12/2006 | Leung et al. | |
| 7,191,554 | B2 | 3/2007 | Almanzar et al. | |
| 7,327,409 | B2 | 2/2008 | Kim et al. | |
| 7,516,565 | B1 | 4/2009 | Tsen | |
| 7,908,776 | B2 | 3/2011 | Ng et al. | |
| 7,920,778 | B2 | 4/2011 | Quah et al. | |
| D646,029 | S | 9/2011 | Choi | |
| D648,494 | S | 11/2011 | Vrdoljak et al. | |
| D648,495 | S | 11/2011 | Ediger et al. | |
| D651,774 | S | 1/2012 | Tobias | |
| 8,151,496 | B2 | 4/2012 | Lee et al. | |
| 8,245,630 | B2 | 8/2012 | Houraney | |
| 8,272,152 | B2 | 9/2012 | Fernandez | |
| D670,876 | S | 11/2012 | Vrdoljak et al. | |
| D674,564 | S | 1/2013 | Mangano | |
| 8,365,446 | B2 | 2/2013 | Ng et al. | |
| 2005/0125934 | A1 * | 6/2005 | Reese | B08B 3/00 15/320 |
| 2006/0018638 | A1 | 1/2006 | Leung | |
| 2007/0143951 | A1 * | 6/2007 | Wu | D06F 87/00 15/320 |
| 2011/0209364 | A1 | 9/2011 | Ng et al. | |
| 2011/0219646 | A1 | 9/2011 | Vrdoljak et al. | |
| 2012/0131822 | A1 | 5/2012 | Pan et al. | |

* cited by examiner

PORTABLE HANDHELD STEAMER APPARATUS

BACKGROUND

1. Technical Field

The present disclosure relates to a hand held apparatus for the care of garments and other items made of fabric. More particularly, the present disclosure relates to a hand held apparatus for applying steam and/or heat to garments, fabrics and the like.

2. Description of Related Art

Portable hand held devices for applying steam are particularly useful in removing wrinkles and improving the appearance of hanging garments, draperies, upholstery, and other items made of fabric. When traveling, these devices may be especially effective for freshening clothes that have been packed in luggage. They are also useful for improving the appearance of hanging draperies without removing them, straightening and flattening upholstery, opening seams, and, generally, for smoothing fabric during sewing operations. In all of these applications, it is not only important to apply steam to the fabric, but to do so in a safe and easy manner. It is also important to be able to apply a desired amount of steam to a particular portion of the fabric being treated. One garment steamer is disclosed in commonly assigned U.S. Pat. No. 7,155,117 to Leung et al., the entire contents of which are incorporated by reference herein.

SUMMARY

Accordingly, the present disclosure is directed to further improvements in steam generating apparatti, particularly, handheld steamers. A steamer apparatus includes a housing defining a steam outlet, a fluid reservoir for storing fluid, a steam generator mounted in the housing and in fluid communication with the fluid reservoir for generating steam and releasing the steam through the steam outlet, a pump for pumping the fluid from the fluid reservoir to the steam generator, a trigger mounted to the housing and a trigger lock associated with the trigger. The trigger is adapted to move from an inoperative condition to an operative condition to activate one of the pump and the steam generator. The trigger lock is movable between a release position permitting free movement of the trigger between the inoperative condition and the operative condition and a lock position securing the trigger in the operative condition.

The steam generator may include a first boiler for heating the steam to a first temperature and a second boiler in fluid communication with the first boiler for heating the steam to a second temperature greater than the first generator. The first temperature is at least about 100° C. and the second temperature is at least about 130° C.

The housing may include a slot extending therethrough for release of heat generated by the steam generator. The slot may be generally crescent-shaped. The housing defines a resting block in opposed relation to the steam outlet. The resting block is dimensioned for positioning upon a support surface to orient the steam outlet facing away from the support surface. An indicator light may be within the resting block for providing visual indication of the pump in the operative position.

An ironing sole plate is mounted to the housing with the steam outlet extending through the ironing soleplate. The ironing sole plate may be dimensioned to be heated by the steam as the steam passes through the steam outlet. Alternatively, the ironing sole plate is in contact with the steam generator whereby heat is transferred from the steam generator to the ironing sole plate. As a further alternative, a heater may be associated with the ironing sole plate to heat the ironing sole plate.

BRIEF DESCRIPTION OF THE DRAWINGS

Embodiment(s) of the present disclosure will be more readily appreciated by reference to the drawings wherein:

FIGS. 10-11 are perspective views of the trigger in release and secured positions respectively;

DETAILED DESCRIPTION OF THE PREFERRED EMBODIMENTS

Figure 1:
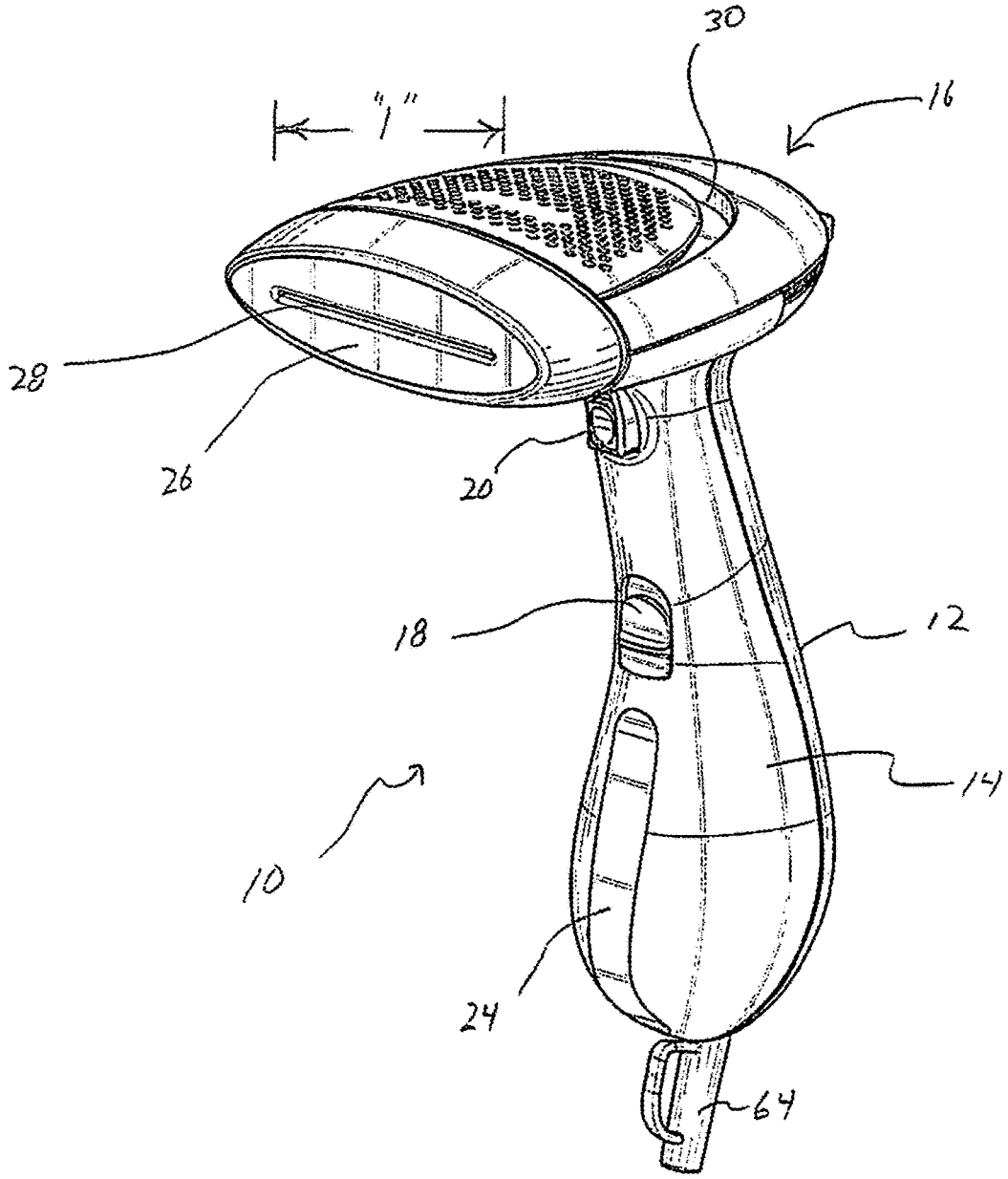
FIGS. 1-2 are perspective views of the handheld steamer apparatus in accordance with the principles of the present disclosure illustrating the handle segment and the head segment.
Figure 2:
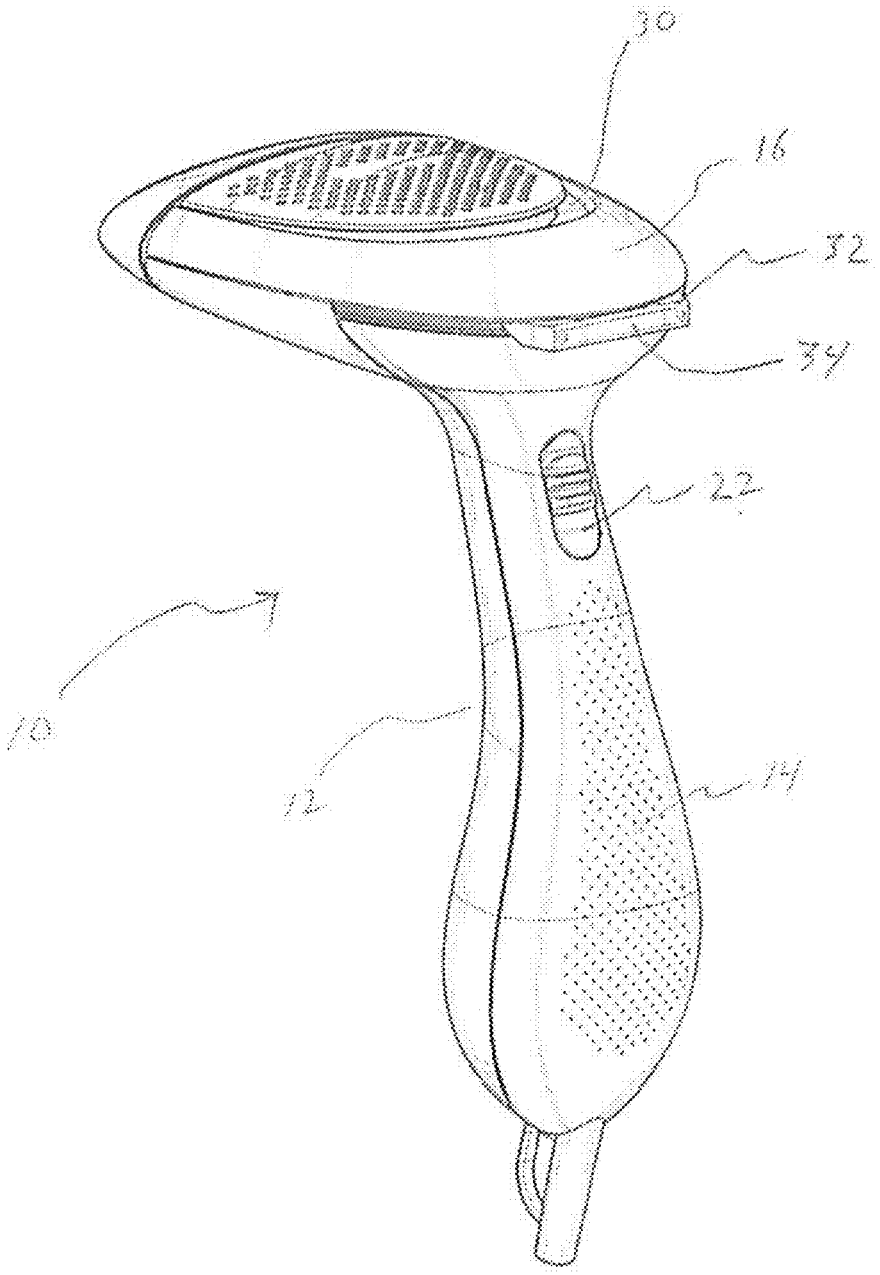
Figure 3:
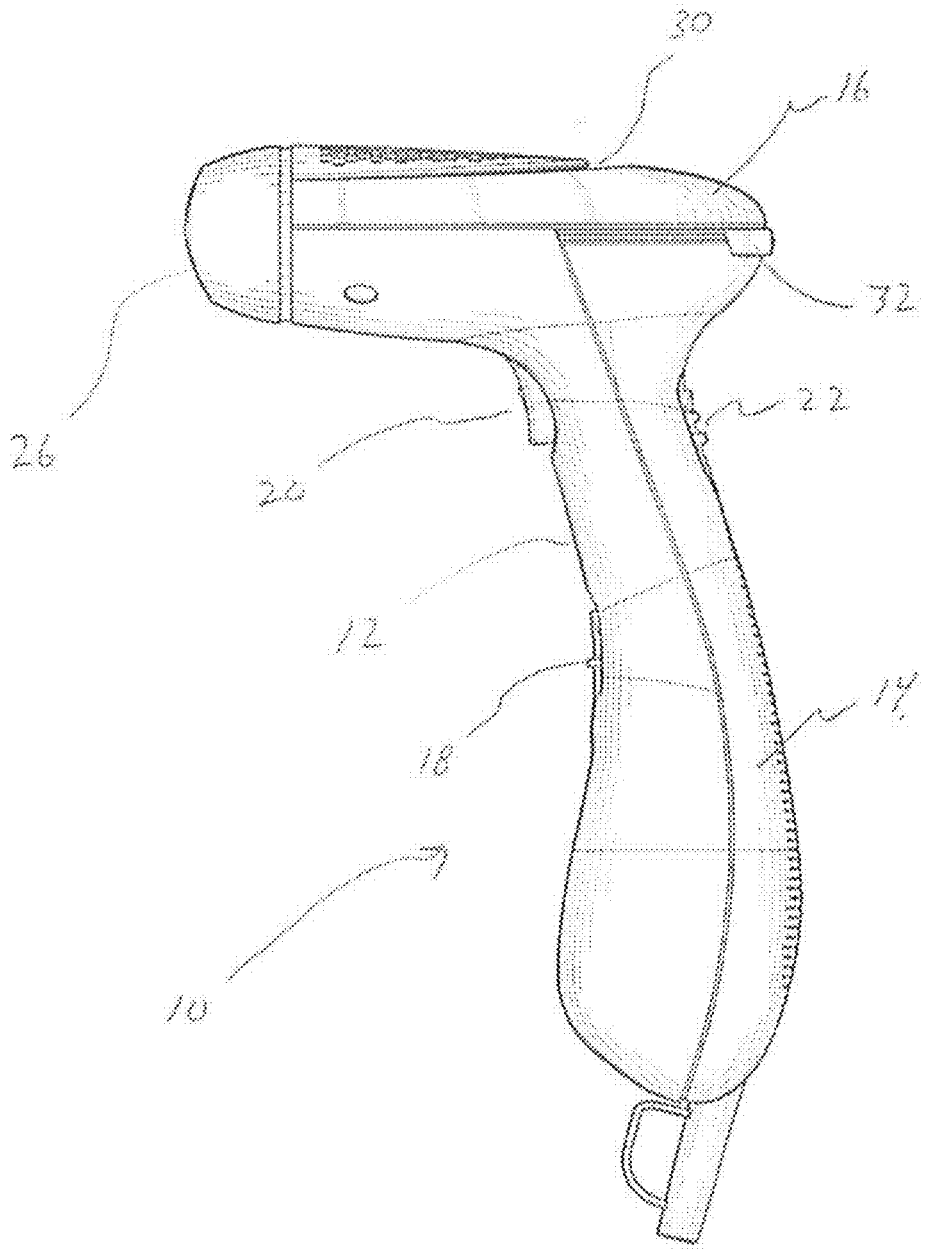
FIG. 3 is a side elevation view of the handheld steamer apparatus.
Figure 4:
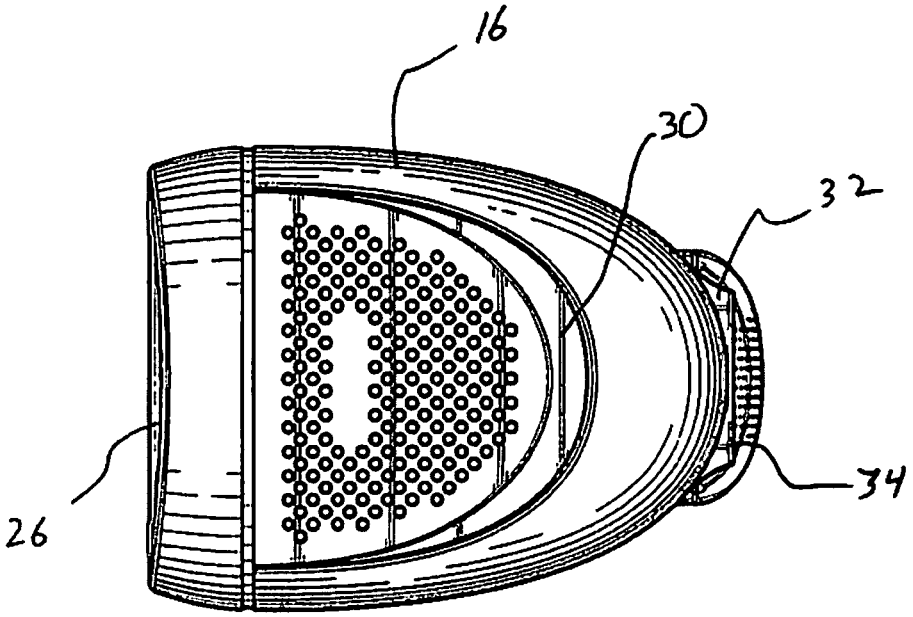
FIG. 4 is a top plan view of the handheld steamer apparatus.

Referring now to FIGS. 1-4, the handheld steamer apparatus 10 in accordance with the principles of the present disclosure is illustrated. The handheld steamer apparatus 10 includes an outer housing 12 defining a general pistol configuration and having a handle segment 14 and a head segment 16. The handle segment 14 is dimensioned for manual engagement by the user. The handle segment 14 includes a reservoir lock 18 and a steam trigger button 20 on the forward side of the handle segment 14 and a steam setting switch 22 on the rear side. The reservoir lock 18 secures a fluid reservoir 24 which is detachable (e.g., removable) from the handle segment 14. The fluid reservoir 24 is selectively released by actuation of the reservoir lock 18. The fluid reservoir 24 contains water or other suitable fluid, and may be refilled once the fluid reservoir 24 is emptied. The steam trigger button 20 activates the double boiler system and may be positioned in a continuous or non-continuous. The operation of the steam trigger button 20 will be discussed in greater detail hereinbelow. The steam setting switch 22 enables the user to select the desired steam temperature depending on the fabric to be ironed.

The head segment 16 includes an ironing soleplate 26 and a steam outlet 28 extending through the soleplate 26. The steam outlet 28 extends along the majority of the length "l" of the ironing soleplate, e.g., at least about 60% of the length "l" and possibly at least 70% of the length "l". This provides a relatively wide steam outlet 28 thereby increasing the effective treatment area of the released steam. The ironing soleplate 26 has an outward bow or curved configuration which facilitates the ironing process when both in a vertical and horizontal application as will be discussed hereinbelow. The ironing soleplate 26 may be made of metal or any other suitable material, e.g., heat conductive material, for distributing heat to the garment.

Figure 5:
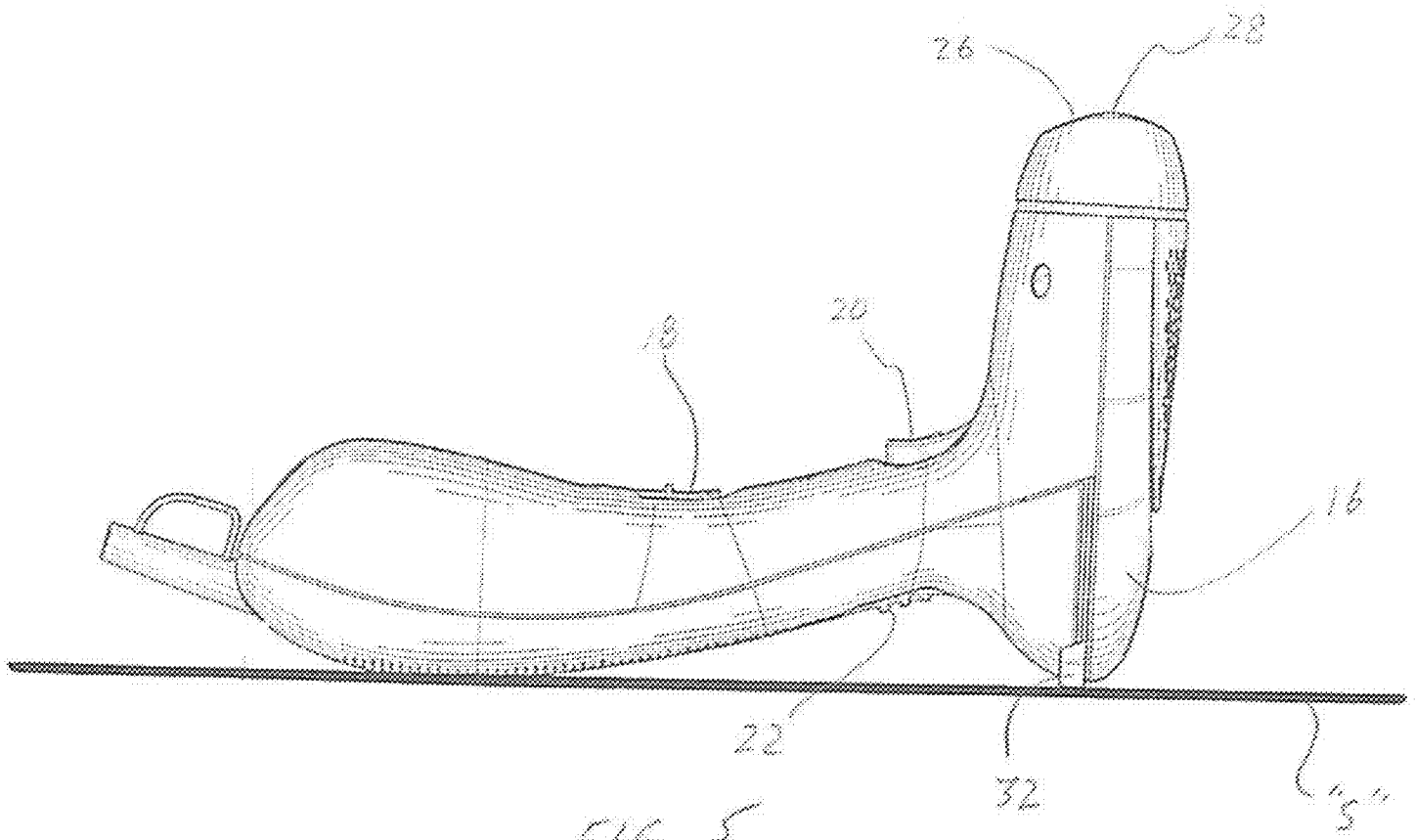
FIG. 5 is a side plan view of the handheld steamer apparatus positioned on a support surface and supported by a resting block on the rear of the head segment.

The top of the head segment 16 includes a generally crescent shaped vent 30 which communicates with the interior of the head segment 16 to release heat generated by the double boiler system thereby minimizing the potential of pressure build-up within the head segment 16. The rear of the head segment 16 includes a resting block or segment 32 dimensioned to permit the operator to place the steamer apparatus 10 on a table or support surface with the ironing soleplate 26 and the steam outlet 28 facing upwardly away from the garment of the support surface. This ensures that the heated components of the steamer apparatus 10 are removed from the garment or the support surface when not in use. The resting block 32 may have a substantially planar surface 34 and defines a width and length sufficient to support the handheld steamer apparatus 10 in the desired position. An indicator light 36 may be disposed within the resting block 32 to provide a visual indicator that the steamer apparatus 10 is in an on or active mode. With this arrangement it is envisioned that the resting block 32 comprises a transparent material. FIG. 5 illustrates the handheld steamer apparatus in the upright position with the resting block placed on a support surface "s" and the ironing soleplate 26 and the nozzle 28 directed in the upward direction.

Figure 7:
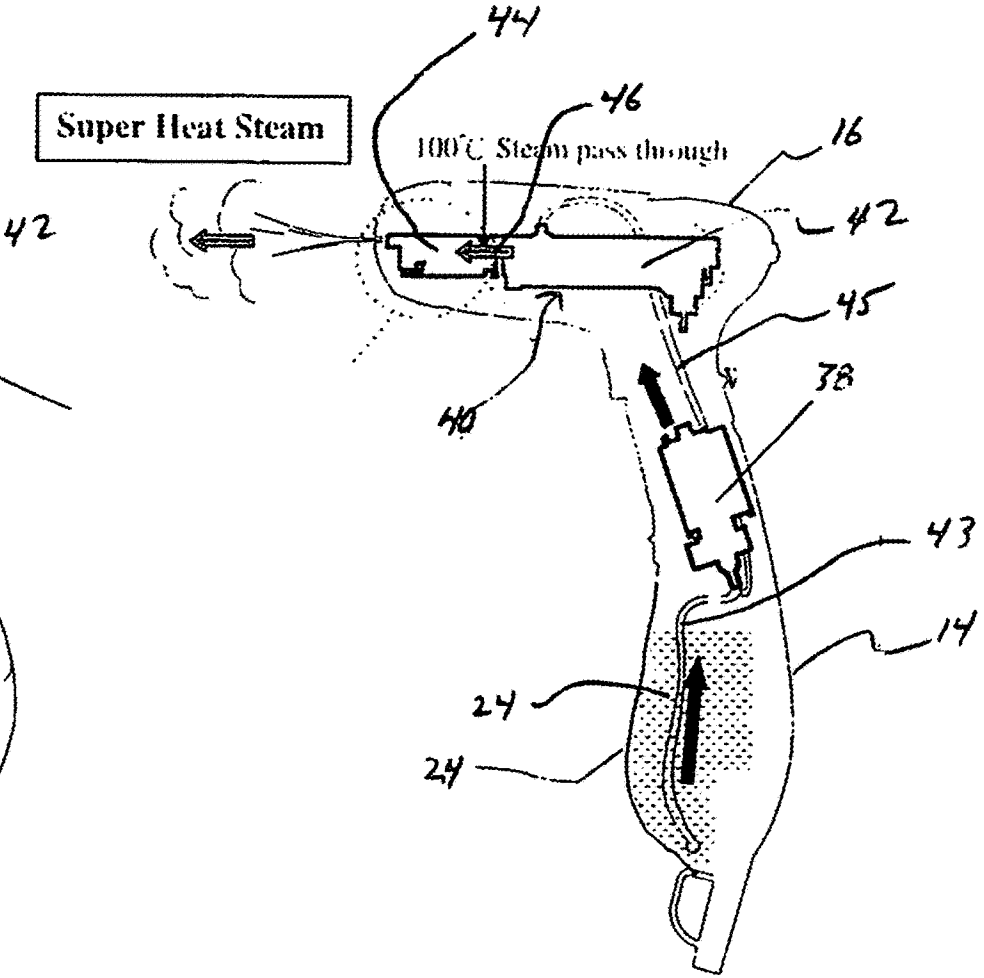
FIGS. 6 and 7 are perspective and side plan views illustrating the double boiler system of the handheld steamer apparatus.
Figure 6:
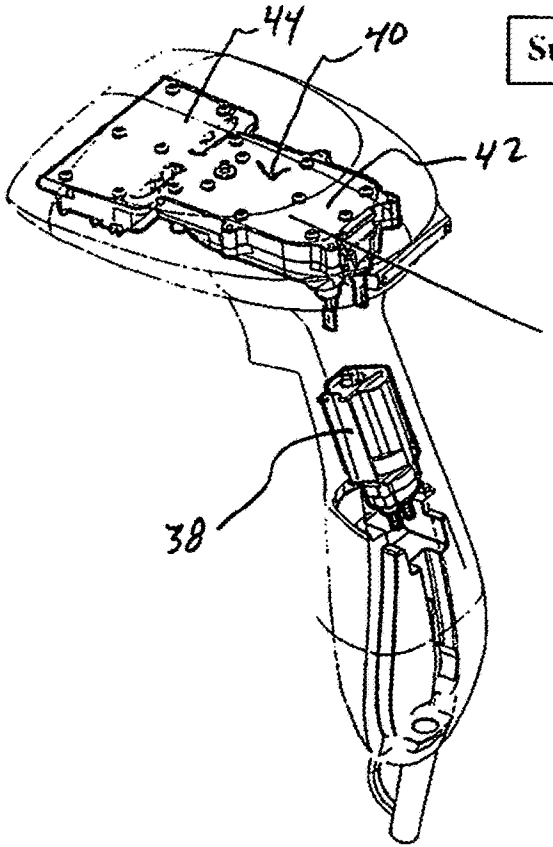
Figure 8:
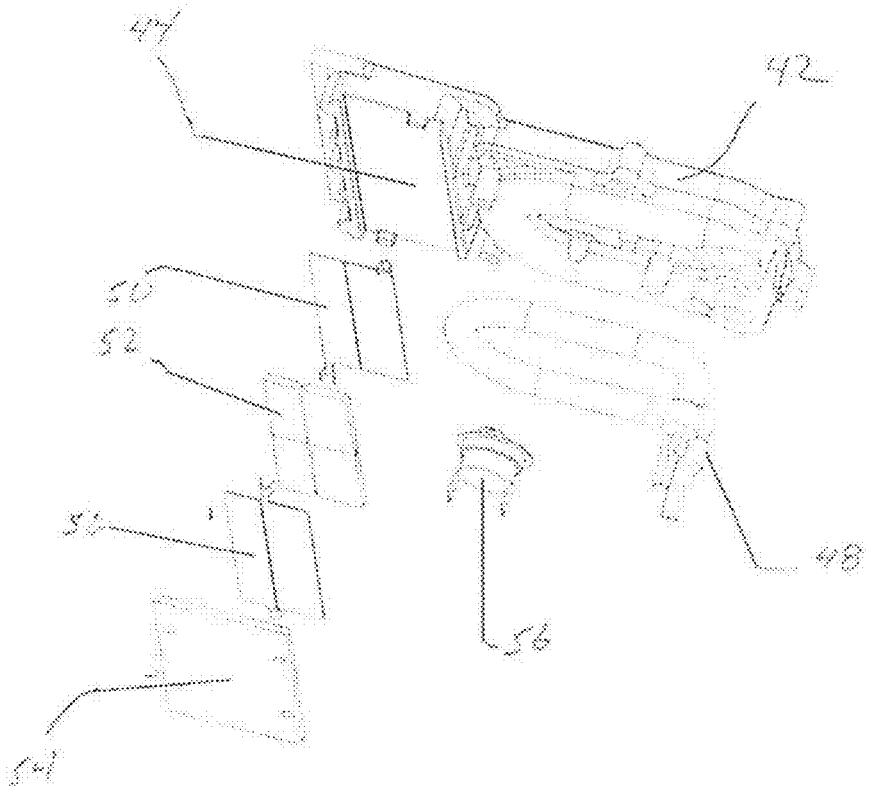
FIG. 8 is a perspective view with parts separated of the first and second heating chambers of the double boiler system.

Referring now to FIGS. 6 and 7, the handheld steamer apparatus 10 includes a boiler system consisting of fluid or water pump 38 and boiler housing 40. The water pump 38 is in fluid communication with the fluid reservoir 24 through appropriate tubing 43, 45 (FIG. 7) to deliver water to the boiler housing 40. The boiler housing 40 includes a first heating chamber 42 and a second heating chamber 44. The first heating chamber 42 will heat the water to generate steam at a first predetermined temperature, e.g., about 100° C. or higher. The second heating chamber 44 is located at the outlet 46 of the first heating chamber 42 and heats the steam to a higher predetermined temperature, e.g., about 130° C. or higher, to generate super steam. The super steam provides a quicker and efficient ironing characteristic to remove wrinkles in the garment, keeps the garment drive after ironing and may kill bacteria due to the high temperature of the steam. Various heater sets, plates and generator means may be incorporated to create the steam within the first and second chambers at the desired temperatures. For example, as depicted in FIG. 8, the first heating chamber 42 may incorporate a U-shaped heater 48 and the second heating chamber 44 may includes a pair of electro-connection plates 50 with an interposed second heater set 52 and a lower heater mounting plate 54. Other dual generator arrangements are also contemplated. It is also envisioned the first and second heating chambers 42, 44 may be heated by the same heater. It is further envisioned that each of the first and second heating chambers 42, 44 may be incorporated in separate boilers which are in fluid communication to heat the steam to the first and second predetermined temperatures. A temperature control 56 in electrical communication with the external steam setting switch 22 can control the temperature of the steam generated.

Figure 9:
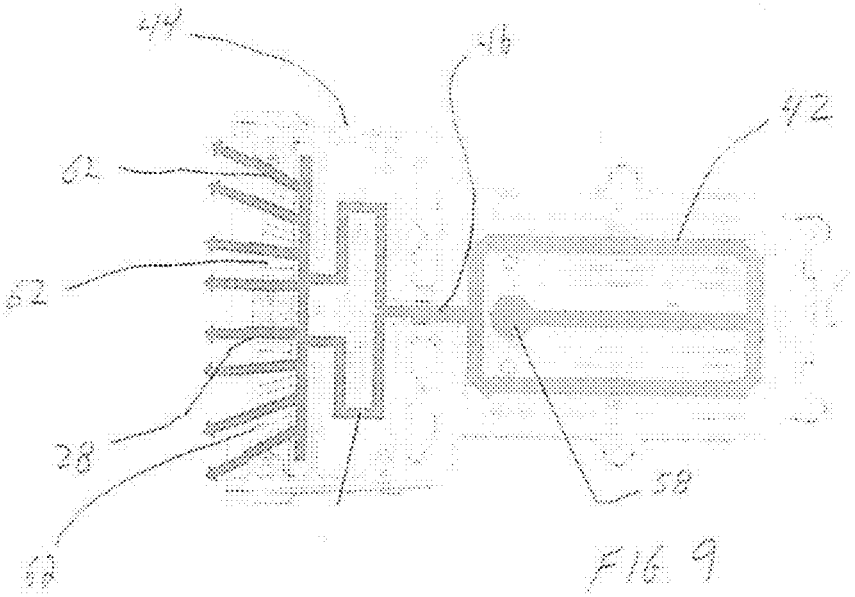
FIG. 9 is a top plan illustrating the flow path of the steam within the first and second heating chambers of the double boiler system.

FIG. 9 illustrates the flow path of the steam generated by the first and second heating chambers 42, 44. The water inlet 58 receives the water from the fluid pump 38, which is circulated through the first heating chamber 42 to be converted to steam at a first predetermined temperature (at least about 100° C.) and released through the outlet 46 of the first chamber 42. The steam is circulated through the second heating chamber 44 and heated or superheated to a second predetermined temperature (at least about 130° C.) and released through the external steam outlet 28 extending through the ironing sole plate 26. The steam outlet 28 may have a plurality of channels 62 to distribute the steam evenly to the garment.

Power for handheld steamer apparatus 10 is derived from an external power source (not shown) through an electrical cable 64 (FIG. 1) The cable 64 provides an electrical connection from the external power source to the fluid pump 38, the double boiler system, and other components of handheld steamer apparatus 10 requiring electrical energy. It should be appreciated that the steamer apparatus 10 may be powered by an internal power source such as a battery. The electrical power from the cable 64 may be controlled through the steam trigger button 20. The steam trigger button 20 serves to complete an electrical circuit which includes the fluid pump 38 either directly or indirectly, e.g., by use of a delay. The steam trigger button 20 operates to cause application of power to the fluid pump 38. In the alternative, or in addition, the steam trigger button 20 may be actuated to activate the double boiler system, with the heat setting being controlled via the steam setting switch 22. In the alternative or in addition, the steam trigger button 20 may operate to cause a variable amount of power to be applied to the fluid pump 38 and/or the double boiler system depending upon the degree of actuation by a user. Suitable safety devices in the form of a fuse, circuit breaker, thermal cut-off, or other safety device appropriate for use in the handheld steamer apparatus 10.

Figure 11:
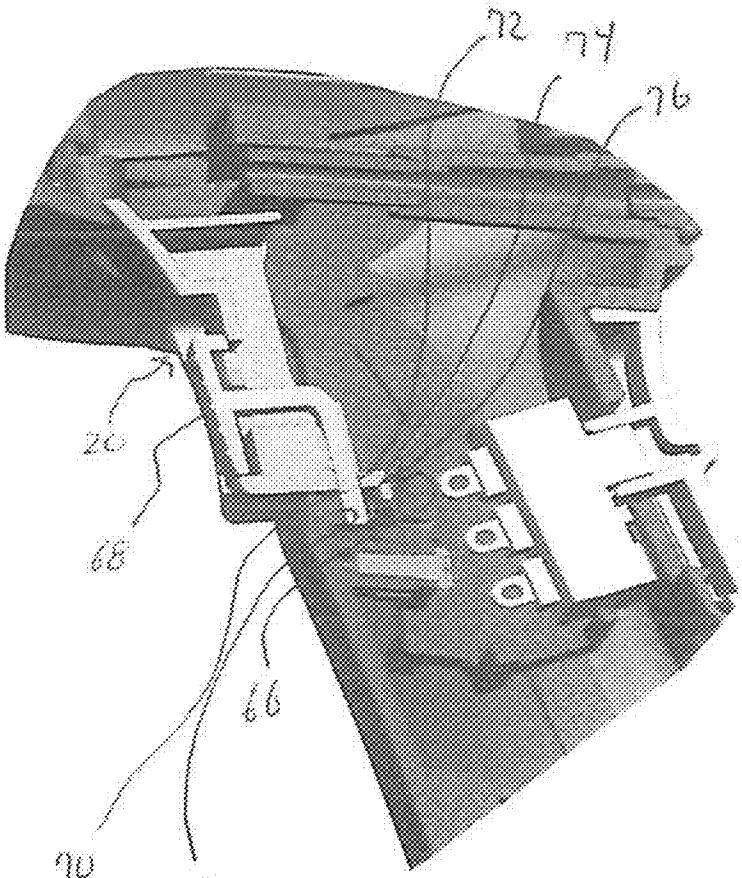

In accordance with one embodiment, the steam trigger button 20 may be activated in a continuous or intermittent mode of operation. For example, with reference to FIGS. 10-11, depression of the steam trigger button 20 completes the electrical circuit to activate the fluid pump 38 and/or the double boiler system as indicated hereinabove. In the intermittent condition of the steam trigger button 20, depression and release of the button 20 will activate and deactivate the electrical circuit. The steam trigger button 20 is normally biased outwardly by coil spring 66, which position corresponds to the deactivated condition of the steam trigger button 20. When continuous power is desired for continuous steam to be released from the handheld steamer apparatus 10, the steam trigger button 20 is depressed and a trigger lock 68 associated with the steam trigger button 20 is slid or depressed from the position depicted in FIG. 10 to the position depicted in FIG. 11. In the position of the trigger lock 68 of FIG. 11, the lower depending locking tab 70 of the trigger lock 68 depends through an opening 72 in the steam trigger button 20 to be received within an internal locking recess 74 of the handle segment 14. The depending locking tab 70 is retained within the internal locking recess 74 through friction and/or via the outward bias of the coil spring 66 which drives the locking tab 70 (either directly or indirectly through engagement with vertical shelf 76 of the steam trigger button 20) against the internal forward surface 78 defining the internal locking recess 74. In this position, the steam trigger button 20 is secured to continuously provide power to the fluid pump 38 and/or the double boiler system. The trigger lock 68 may be slid upwardly to the position of FIG. 10 when continuous operation is no longer desired. Thus, the trigger lock 68 is movable between a release position depicted in FIG. 10 permitting free movement of the trigger button 20 and a lock position securing the trigger button 20 and maintaining the fluid pump 38 and/or the double boiler system in an operative condition. It is also possible to provide continuous steam by manually maintaining the steam trigger button 20 in the depressed condition of FIG. 11 without securing the trigger lock 68.

Figure 12:
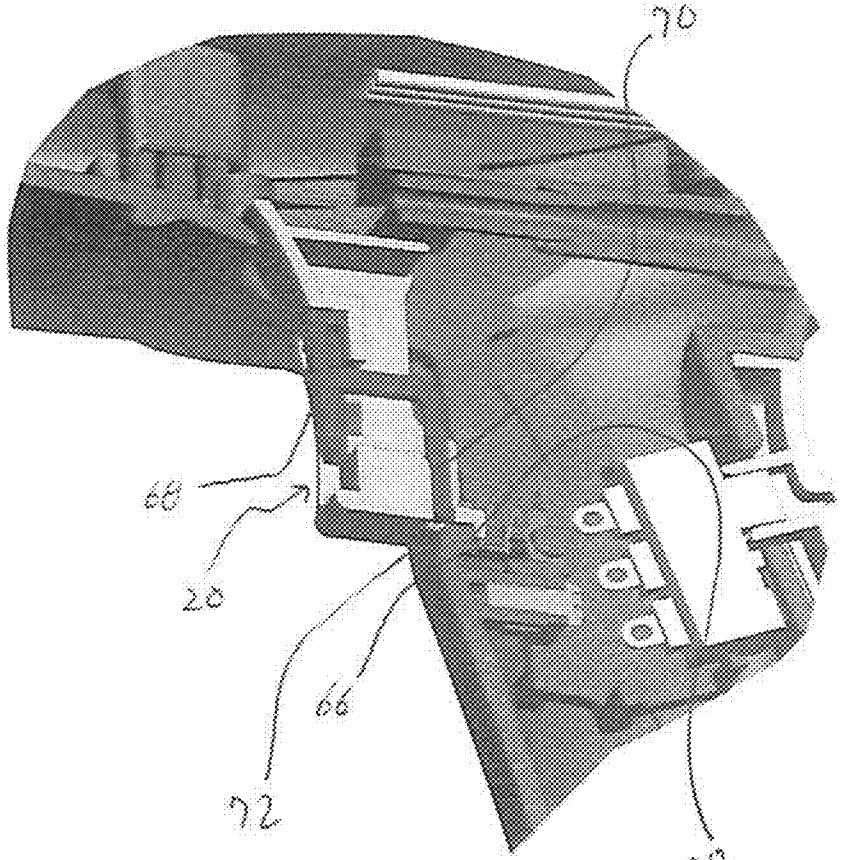
FIGS. 12-14 are views illustrating various arrangements for heating the iron soleplate of the handheld steamer.
Figure 12:
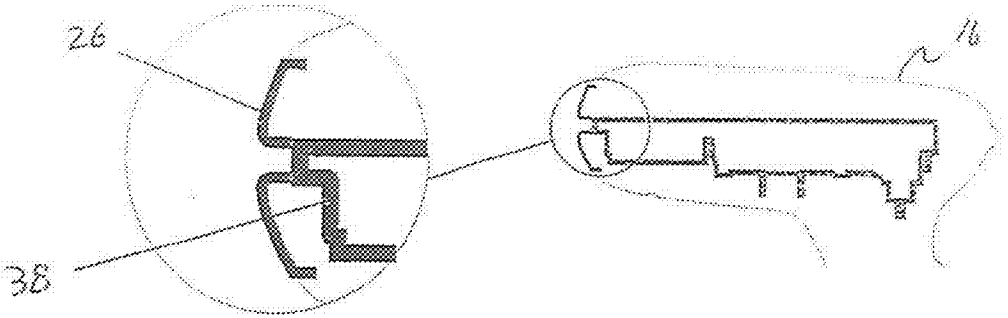
Figure 13:
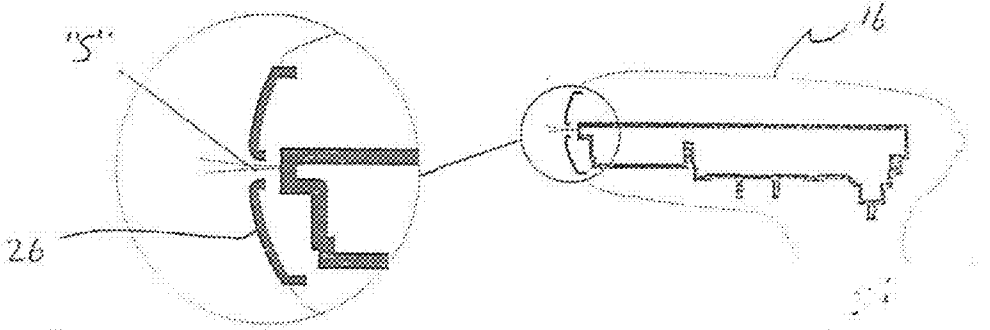
Figure 14:
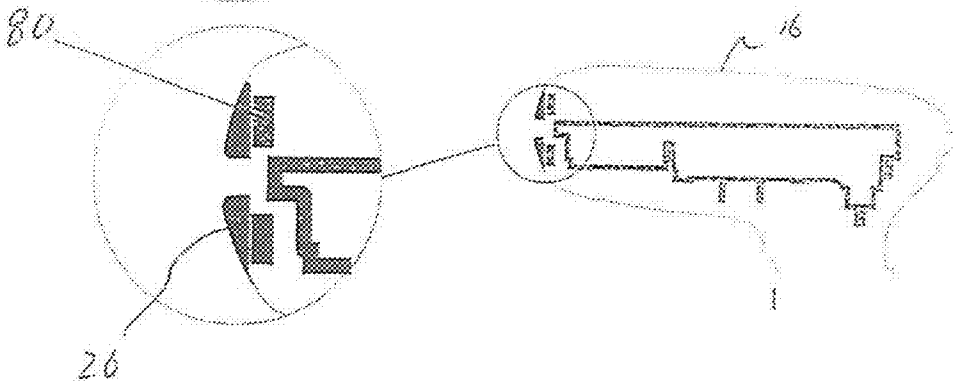

FIGS. 12-14 illustrate various arrangements to heat or preheat the ironing soleplate 26 in accordance with the principles of the present disclosure. With the arrangement depicted in FIG. 12, the ironing soleplate 26 is directly in contact with or attached to the boiler housing 38 whereby heat is transferred from the boiler housing 38 to the soleplate 26. The boiler housing 38 may be fabricated from a heat conductive metal such as cast aluminum or cast iron. In the embodiment of FIG. 13, the steam "s" is passed through the ironing soleplate 26 and thereby heats the soleplate 26 to the desired temperature through conduction and/or convection. In the embodiment of FIG. 14, a separate heater 80 is connected to the sole plate 26. The heater 80 may be activated through the steam trigger button 20 or another button or switch associated with the handle segment 14. The separate heater may provide for more rapid heating of the soleplate.

Figure 16:
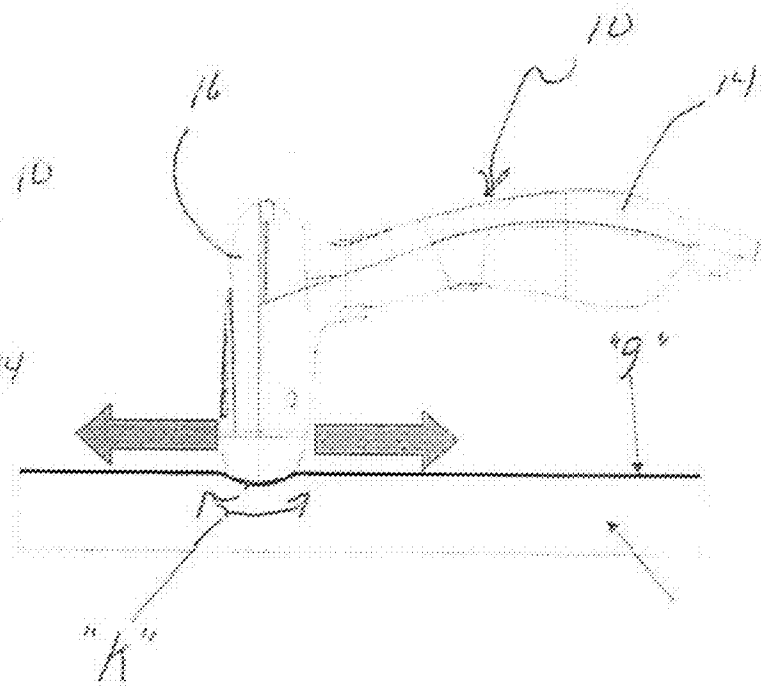
FIGS. 15 and 16 illustrate use of the handheld steamer apparatus in respective vertical and horizontal arrangements relative to the garment.
Figure 15:
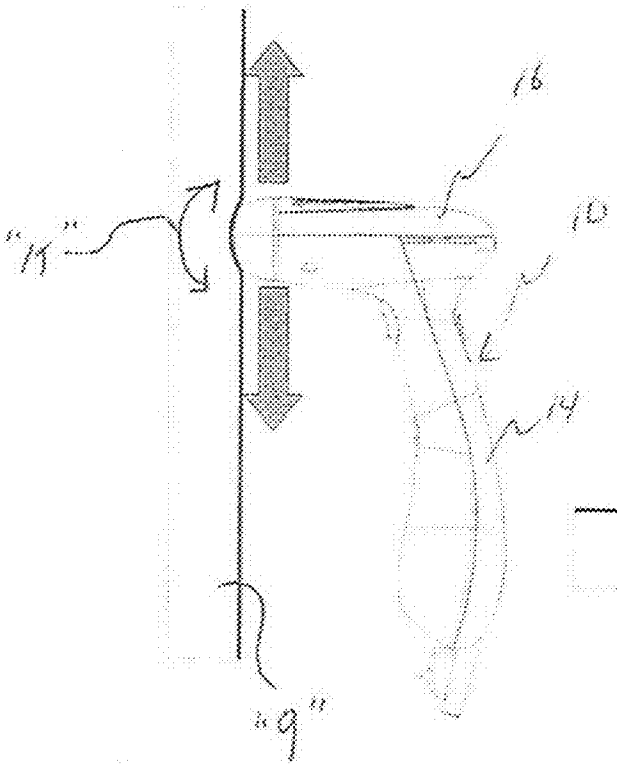

FIGS. 15-16 illustrate the use of the handheld steamer apparatus 10 in both a vertical application (FIG. 15) and a horizontal application (FIG. 16). During use, the curved or bowed configuration of the ironing soleplate 26 permits the operator to manipulate and pivot the handheld steamer apparatus 10 relative to the garment and about the ironing soleplate 26 as depicted by directional arrows "k". This bowed configuration facilitates use of the steamer apparatus 10 by permitting the operator to address the garment "g" at a number of angles. This is not possible with conventional flat irons.

Figure 17:
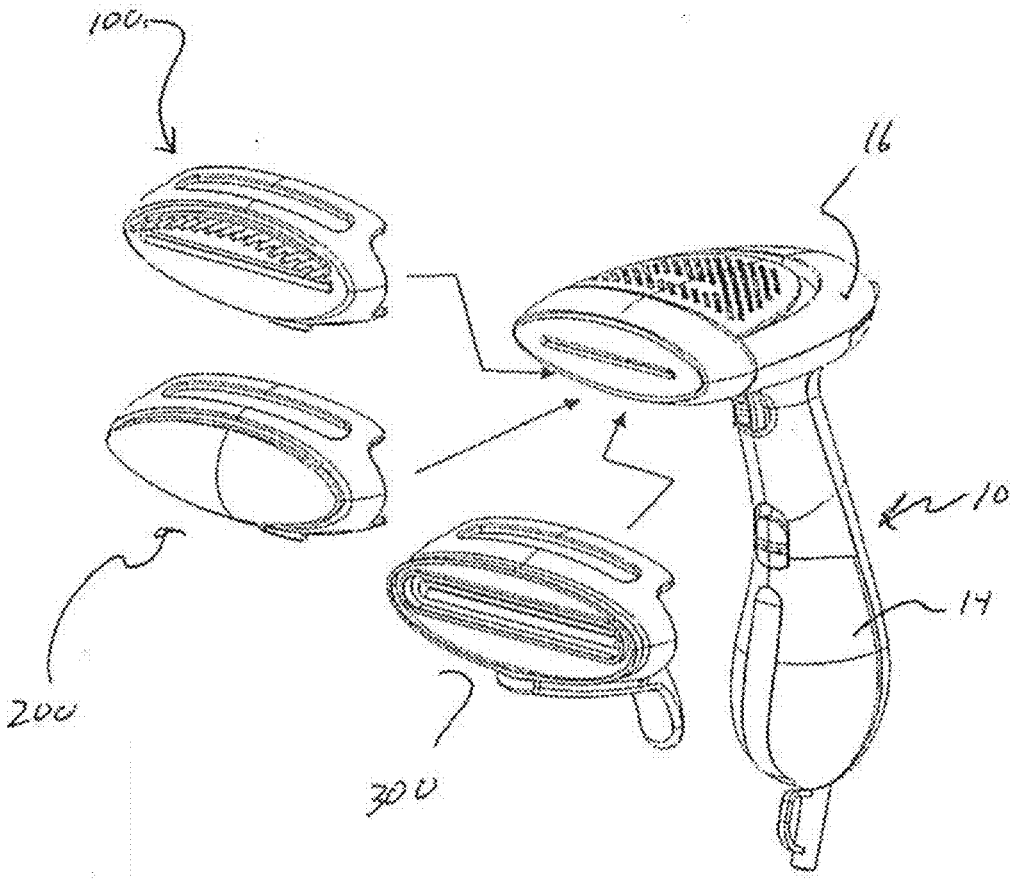
FIG. 17 illustrates various attachments for use with the handheld steamer apparatus.

FIG. 17 illustrates various attachments contemplated for use with the handheld steamer apparatus 10. The attachments include a lint brush attachment 100, a soft fabric cushion attachment 200 and a creaser attachment 300. The attachments 100, 200, 300 may be fit about the periphery of the front end of the head segment 16 in frictional relationship therewith.

The above description and the drawings are provided for the purpose of describing embodiments of the present disclosure and are not intended to limit the scope of the disclosure in any way. It will be apparent to those skilled in the art that various modifications and variations can be made without departing from the spirit or scope of the disclosure. Thus, it is intended that the present disclosure cover the modifications and variations of this disclosure provided they come within the scope of the appended claims and their equivalents.

What is claimed is:

1. A steamer apparatus, which compises:

a housing defining a steam outlet;

a fluid reservoir for storing fluid;

a steam generator mounted in said housing and in fluid communication with said fluid reservoir for generating steam and releasing said steam through said steam outlet, said steam generator including a first boiler for heating steam to a first temperature and a second boiler in fluid communication with said first boiler for heating said steam to a second temperature greater than said first generator;

a pump for pumping said fluid from said fluid reservoir to said steam generator;

a trigger mounted to said housing, said trigger adapted to move from an inoperative condition to an operative condition to activate one of said pump and said steam generator; and a trigger lock associated with said trigger, said trigger lock movable between a release position permitting free movement of said trigger between said inoperative condition and said operative condition and a lock position securing said trigger in said operative condition.

2. The steamer apparatus according to claim 1 wherein said first temperature is at least about 100° C. and said second temperature is at least about 130° C.

3. The steamer apparatus according to claim 1 wherein said housing includes a slot extending therethrough for release of heat generated by said steam generator.

4. The steamer apparatus according to claim 3 wherein said slot is generally crescent-shaped.

5. A steamer apparatus, which comprises:

a housing defining a steam outlet, said housing defines a resting block in opposed relation to said steam outlet, said resting block dimensioned for positioning upon a support surface to orient said steam outlet facing away from said support surface;

a fluid reservoir for storing fluid;

a steam generator mounted in said housing and in fluid communication with said fluid reservoir for generating steam and releasing said steam through said steam outlet;

a pump for pumping said fluid from said fluid reservoir to said steam generator;

a trigger mounted to said housing, said trigger adapted to move from an inoperative condition to an operative condition to activate one of said pump and said steam generator;

a trigger lock associated with said trigger, said trigger lock movable between a release position permitting free movement of said trigger between said inoperative condition and said operative condition and a lock position securing said trigger in said operative condition; and an indicator light within said resting block for providing visual indication of said pump in said operative position.

6. The steamer apparatus according to claim 1 including an ironing sole plate mounted to said housing, said steam outlet extending through said ironing sole plate.

7. The steamer apparatus according to claim 6 wherein said ironing sole plate is dimensioned to be heated by said steam as said steam passes through said steam outlet.

8. The steamer apparatus according to claim 6 wherein said ironing sole plate is in contact with said steam generator whereby heat is transferred from said steam generator to said ironing sole plate.

9. The steamer apparatus according to claim 6 including a heater associated with said ironing sole plate to heat said ironing sole plate.

10. A steamer apparatus, which comprises:

a housing defining a steam outlet;

a fluid reservoir for storing fluid;

a steam generator mounted in said housing and in fluid communication with said fluid reservoir for generating steam and releasing said steam through said steam outlet, said steam generator including a first boiler for heating said steam to a first temperature and a second boiler in fluid communication with said first boiler for heating said steam to a second temperature greater than said first generator;

a pump for pumping said fluid from said fluid reservoir to said steam generator; and a trigger mounted to said housing, said trigger adapted to move from an inoperative condition to an operative condition to activate one of said pump or said steam generator.

11. The steamer apparatus according to claim 10 including an indicator light within said housing for providing visual indication of said pump in said operative position.

12. The steamer apparatus according to claim 10 including an ironing sole plate mounted to said housing, said steam outlet extending through said ironing sole plate.

* * * * *